US007220053B2

(12) United States Patent
Wu

(10) Patent No.: US 7,220,053 B2
(45) Date of Patent: May 22, 2007

(54) FLEXIBLE COMPOSITE BAG FOR VACUUM SEALING

(75) Inventor: Hongyu Wu, San Jose, CA (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 11/013,309

(22) Filed: Dec. 14, 2004

(65) Prior Publication Data

US 2005/0220373 A1 Oct. 6, 2005

Related U.S. Application Data

(60) Provisional application No. 60/529,784, filed on Dec. 16, 2003.

(51) Int. Cl.
*B65D 33/00* (2006.01)
*B65D 33/01* (2006.01)

(52) U.S. Cl. ..... 383/105; 383/100

(58) Field of Classification Search ..... 383/105, 383/100–103

See application file for complete search history.

(56) References Cited

U.S. PATENT DOCUMENTS

| | | | |
|---|---|---|---|
| 274,447 | A | 3/1883 | Kennish |
| 1,938,593 | A | 12/1933 | Jarrier |
| 2,085,766 | A | 7/1937 | Potdevin et al. |
| 2,105,376 | A | 1/1938 | Scott |
| 2,265,075 | A | 12/1941 | Knuetter |
| 2,387,812 | A | 10/1945 | Sonneborn et al. |
| 2,429,482 | A | 10/1947 | Munters |
| 2,480,316 | A | 8/1949 | Blair et al. |
| 2,607,712 | A | 8/1952 | Sturken |
| 2,609,314 | A | 9/1952 | Engel et al. |
| 2,633,442 | A | 3/1953 | Caldwell |
| 2,642,372 | A | 6/1953 | Chittick |
| 2,670,501 | A | 3/1954 | Michiels |
| 2,690,206 | A | 9/1954 | Mueller |
| 2,695,741 | A | 11/1954 | Haley |
| 2,759,866 | A | 8/1956 | Seymour |
| 2,772,712 | A | 12/1956 | Post |
| 2,776,452 | A | 1/1957 | Chavannes |
| 2,778,173 | A | 1/1957 | Taunton |
| 2,789,609 | A | 4/1957 | Post |
| 2,821,338 | A | 1/1958 | Metzger |
| 2,856,323 | A | 10/1958 | Gordon |
| 2,858,247 | A | 10/1958 | De Swart |
| 2,913,030 | A | 11/1959 | Fisher |
| 2,916,411 | A | 12/1959 | Villoresi |
| 2,960,144 | A | 11/1960 | Graf |
| 3,026,231 | A | 3/1962 | Chavannes |
| 3,060,985 | A | 10/1962 | Vance et al. |

(Continued)

FOREIGN PATENT DOCUMENTS

| | | |
|---|---|---|
| EP | 0 723 915 | 7/1996 |

(Continued)

*Primary Examiner*—Jes F. Pascua
(74) *Attorney, Agent, or Firm*—Lawrence J. Shurupoff

(57) ABSTRACT

A flexible composite bag for use with vacuum packaging appliances is disclosed. The flexible composite bag includes an inner bag that is enclosed by an outer bag. Two patterned panels make up the inner bag such that intercommunicating channels are formed when the two panels are superimposed on one another.

30 Claims, 7 Drawing Sheets

U.S. PATENT DOCUMENTS

| | | | |
|---|---|---|---|
| 3,077,262 | A | 2/1963 | Gaste |
| 3,077,428 | A | 2/1963 | Heuser et al. |
| 3,098,563 | A | 7/1963 | Skees |
| 3,102,676 | A | 9/1963 | Danelli et al. |
| 3,113,715 | A | 12/1963 | Pangrac |
| 3,135,411 | A | 6/1964 | Osborne |
| 3,141,221 | A | 7/1964 | Faulls, Jr. |
| 3,142,599 | A | 7/1964 | Chavannes |
| 3,149,772 | A | 9/1964 | Olsson |
| 3,160,323 | A | 12/1964 | Weisberg |
| 3,224,574 | A | 12/1965 | McConnell et al. |
| 3,237,844 | A | 3/1966 | Hughes |
| 3,251,463 | A | 5/1966 | Bodet |
| 3,325,084 | A | 6/1967 | Ausnit |
| 3,334,805 | A | 8/1967 | Halbach |
| 3,381,887 | A | 5/1968 | Lowry |
| 3,411,698 | A | 11/1968 | Reynolds |
| 3,423,231 | A | 1/1969 | Lutzmann |
| 3,516,217 | A | 6/1970 | Gildersleeve |
| 3,533,548 | A | 10/1970 | Taterka |
| 3,565,147 | A | 2/1971 | Ausnit |
| 3,575,781 | A | 4/1971 | Pezely |
| 3,595,467 | A | 7/1971 | Goglio |
| 3,595,722 | A | 7/1971 | Dawbarn |
| 3,595,740 | A | 7/1971 | Gerow |
| 3,600,267 | A | 8/1971 | McFedries, Jr. |
| 3,661,677 | A | 5/1972 | Wang |
| 3,785,111 | A | 1/1974 | Pike |
| 3,799,427 | A | 3/1974 | Goglio |
| 3,809,217 | A | 5/1974 | Harrison |
| 3,833,166 | A | 9/1974 | Murray |
| 3,895,153 | A | 7/1975 | Johnston et al. |
| 3,908,070 | A | 9/1975 | Marzolf |
| 3,937,395 | A | 2/1976 | Lawes |
| 3,958,391 | A | 5/1976 | Kujubu |
| 3,958,693 | A | 5/1976 | Greene |
| 3,980,226 | A | 9/1976 | Franz |
| 3,998,499 | A | 12/1976 | Chiarotto |
| 4,018,253 | A | 4/1977 | Kaufman |
| 4,066,167 | A | 1/1978 | Hanna et al. |
| 4,098,404 | A | 7/1978 | Markert |
| 4,104,404 | A | 8/1978 | Bieler et al. |
| 4,105,491 | A | 8/1978 | Haase et al. |
| 4,155,453 | A | 5/1979 | Ono |
| 4,164,111 | A | 8/1979 | Di Bernardo |
| 4,179,862 | A | 12/1979 | Landolt |
| 4,186,786 | A | 2/1980 | Kirkpatrick |
| 4,212,337 | A | 7/1980 | Kamp |
| 4,215,725 | A | 8/1980 | Callet et al. |
| 4,295,566 | A | 10/1981 | Vincek |
| 4,310,118 | A | 1/1982 | Kisida et al. |
| 4,340,558 | A | 7/1982 | Hendrickson |
| 4,370,187 | A | 1/1983 | Katagiri et al. |
| 4,372,921 | A | 2/1983 | Sanderson et al. |
| 4,449,243 | A | 5/1984 | Platel |
| 4,486,923 | A | 12/1984 | Briggs |
| 4,532,652 | A | 7/1985 | Herrington |
| 4,551,379 | A | 11/1985 | Kerr |
| 4,569,712 | A | 2/1986 | Shibano et al. |
| 4,575,990 | A | 3/1986 | Von Bismarck |
| 4,576,283 | A | 3/1986 | Fafournox |
| 4,576,285 | A | 3/1986 | Goglio |
| 4,579,756 | A | 4/1986 | Edgel |
| 4,583,347 | A | 4/1986 | Nielsen |
| 4,658,434 | A | 4/1987 | Murray |
| 4,669,124 | A | 5/1987 | Kimura |
| 4,672,684 | A | 6/1987 | Barnes et al. |
| 4,683,702 | A | 8/1987 | Vis |
| 4,705,174 | A | 11/1987 | Goglio |
| 4,712,574 | A | 12/1987 | Perrott |
| 4,747,702 | A | 5/1988 | Scheibner |
| 4,756,422 | A | 7/1988 | Kristen |
| 4,756,629 | A | 7/1988 | Tilman et al. |
| 4,778,282 | A | 10/1988 | Borchardt et al. |
| 4,786,285 | A | 11/1988 | Jambor |
| 4,812,056 | A | 3/1989 | Zieke |
| 4,834,554 | A | 5/1989 | Stetler, Jr. et al. |
| 4,841,603 | A | 6/1989 | Ragni |
| 4,871,264 | A | 10/1989 | Robbins, III et al. |
| 4,877,334 | A | 10/1989 | Cope |
| 4,887,912 | A | 12/1989 | Stumpf |
| 4,890,637 | A | 1/1990 | Lamparter |
| 4,892,414 | A | 1/1990 | Ausnit |
| 4,903,718 | A | 2/1990 | Sullivan |
| 4,906,108 | A | 3/1990 | Herrington et al. |
| 4,913,561 | A | 4/1990 | Beer |
| 4,917,506 | A | 4/1990 | Scheibner |
| 4,917,844 | A | 4/1990 | Komai et al. |
| 4,941,310 | A | 7/1990 | Kristen |
| 4,953,708 | A | 9/1990 | Beer et al. |
| 4,973,171 | A | 11/1990 | Bullard |
| 5,006,056 | A | 4/1991 | Mainstone et al. |
| 5,040,904 | A | 8/1991 | Cornwell |
| 5,048,269 | A | 9/1991 | Deni |
| D320,549 | S | 10/1991 | McKellar et al. |
| 5,053,091 | A | 10/1991 | Giljam et al. |
| 5,063,639 | A | 11/1991 | Boeckmann et al. |
| 5,080,155 | A | 1/1992 | Crozier |
| 5,097,956 | A | 3/1992 | Davis |
| 5,098,497 | A | 3/1992 | Brinley |
| 5,106,688 | A | 4/1992 | Bradfute et al. |
| 5,111,838 | A | 5/1992 | Langston |
| 5,116,444 | A | 5/1992 | Fox |
| 5,121,590 | A | 6/1992 | Scanlan |
| 5,142,970 | A | 9/1992 | ErkenBrack |
| 5,203,458 | A | 4/1993 | Cornwell |
| 5,209,264 | A | 5/1993 | Koyanagi |
| D338,399 | S | 8/1993 | Conte, Jr. |
| 5,240,112 | A | 8/1993 | Newburger |
| 5,242,516 | A | 9/1993 | Custer et al. |
| 5,246,114 | A | 9/1993 | Underwood |
| 5,252,379 | A | 10/1993 | Kuribayashi et al. |
| 5,332,095 | A | 7/1994 | Wu |
| 5,333,736 | A | 8/1994 | Kawamura |
| 5,339,959 | A | 8/1994 | Cornwell |
| 5,352,323 | A | 10/1994 | Chi |
| 5,362,351 | A | 11/1994 | Karszes |
| 5,368,394 | A | 11/1994 | Scott et al. |
| 5,371,925 | A | 12/1994 | Sawatsky |
| 5,373,965 | A | 12/1994 | Halm et al. |
| 5,397,182 | A | 3/1995 | Gaible et al. |
| 5,402,906 | A | 4/1995 | Brown et al. |
| RE34,929 | E | 5/1995 | Kristen |
| D360,578 | S | 7/1995 | Dees |
| 5,445,275 | A | 8/1995 | Curley et al. |
| 5,450,963 | A | 9/1995 | Carson |
| 5,480,030 | A | 1/1996 | Sweeney et al. |
| 5,526,843 | A | 6/1996 | Wolf et al. |
| 5,540,500 | A | 7/1996 | Tanaka |
| 5,542,902 | A | 8/1996 | Richison et al. |
| 5,544,752 | A | 8/1996 | Cox |
| 5,549,944 | A | 8/1996 | Abate |
| 5,551,213 | A | 9/1996 | Koelsch et al. |
| 5,554,423 | A | 9/1996 | Abate |
| 5,584,409 | A | 12/1996 | Chemberlen |
| 5,592,697 | A | 1/1997 | Young |
| 5,618,111 | A * | 4/1997 | Porchia et al. ..... 383/63 |
| 5,620,098 | A | 4/1997 | Boos et al. |
| 5,638,664 | A | 6/1997 | Levsen et al. |
| 5,655,273 | A | 8/1997 | Tomic et al. |
| 5,656,209 | A | 8/1997 | Benz et al. |
| 5,665,456 | A | 9/1997 | Kannankeril et al. |
| 5,689,866 | A | 11/1997 | Kasai et al. |
| 5,699,936 | A | 12/1997 | Sakamoto |

| | | | |
|---|---|---|---|
| 5,701,996 | A | 12/1997 | Goto et al. |
| 5,709,467 | A | 1/1998 | Galliano, II |
| 5,735,395 | A | 4/1998 | Lo |
| 5,749,493 | A | 5/1998 | Boone et al. |
| 5,765,608 | A | 6/1998 | Kristen |
| 5,772,034 | A | 6/1998 | Lin |
| 5,812,188 | A | 9/1998 | Adair |
| 5,829,884 | A | 11/1998 | Yeager |
| 5,839,582 | A | 11/1998 | Strong et al. |
| 5,873,217 | A | 2/1999 | Smith |
| 5,874,155 | A | 2/1999 | Gehrke et al. |
| 5,881,881 | A | 3/1999 | Carrington |
| 5,893,822 | A | 4/1999 | Deni et al. |
| 5,898,113 | A | 4/1999 | Vercere |
| 5,908,245 | A | 6/1999 | Bost et al. |
| 5,915,596 | A | 6/1999 | Credle, Jr. |
| 5,927,336 | A | 7/1999 | Tanaka et al. |
| 5,928,762 | A | 7/1999 | Aizawa et al. |
| D413,258 | S | 8/1999 | Voller |
| 5,931,189 | A | 8/1999 | Sweeney et al. |
| 5,941,421 | A | 8/1999 | Overman et al. |
| 5,941,643 | A | 8/1999 | Linkiewicz |
| 5,954,196 | A | 9/1999 | Lin |
| 5,957,831 | A | 9/1999 | Adair |
| 5,971,613 | A | 10/1999 | Bell |
| 5,996,800 | A | 12/1999 | Pratt |
| 6,021,624 | A | 2/2000 | Richison et al. |
| 6,023,914 | A | 2/2000 | Richison et al. |
| 6,029,810 | A | 2/2000 | Chen |
| 6,030,652 | A | 2/2000 | Hanus |
| 6,035,769 | A | 3/2000 | Nomura et al. |
| 6,039,182 | A | 3/2000 | Light |
| 6,045,006 | A | 4/2000 | Fraxier et al. |
| 6,045,264 | A | 4/2000 | Miniea |
| 6,053,606 | A | 4/2000 | Yamaguchi et al. |
| D425,786 | S | 5/2000 | Voller |
| 6,059,457 | A | 5/2000 | Sprehe et al. |
| 6,070,728 | A | 6/2000 | Overby et al. |
| 6,074,677 | A | 6/2000 | Croft |
| 6,076,967 | A | 6/2000 | Beaudette |
| 6,077,373 | A | 6/2000 | Fletcher et al. |
| 6,089,271 | A | 7/2000 | Tani |
| 6,105,821 | A | 8/2000 | Christine et al. |
| 6,116,781 | A | 9/2000 | Skeens |
| 6,161,716 | A | 12/2000 | Oberhofer et al. |
| 6,164,826 | A | 12/2000 | Petkovsek |
| 6,202,849 | B1 | 3/2001 | Graham |
| 6,220,702 | B1 | 4/2001 | Nakamura et al. |
| 6,224,528 | B1 | 5/2001 | Bell |
| 6,227,706 | B1 | 5/2001 | Tran |
| 6,231,234 | B1 | 5/2001 | Gebhardt |
| 6,231,236 | B1 | 5/2001 | Tilman |
| 6,274,181 | B1 | 8/2001 | Richison et al. |
| D451,542 | S | 12/2001 | Ishizawa et al. |
| 6,357,915 | B2 | 3/2002 | Anderson |
| 6,402,873 | B1 | 6/2002 | Fujii et al. |
| 6,408,872 | B1 | 6/2002 | Skeens et al. |
| 6,423,356 | B2 | 7/2002 | Richison et al. |
| 6,520,071 | B1 | 2/2003 | Lanza |
| 6,715,644 | B2 * | 4/2004 | Wilford ..... 222/95 |
| 6,799,680 | B2 * | 10/2004 | Mak ..... 206/524.8 |
| 2001/0023572 | A1 | 9/2001 | Savage et al. |
| 2003/0089737 | A1 * | 5/2003 | Wilford ..... 222/107 |
| 2004/0000501 | A1 | 1/2004 | Shah et al. |
| 2004/0000502 | A1 | 1/2004 | Shah et al. |
| 2004/0000503 | A1 | 1/2004 | Shah et al. |
| 2004/0007494 | A1 | 1/2004 | Popeil et al. |

FOREIGN PATENT DOCUMENTS

| | | |
|---|---|---|
| EP | 0 836 927 | 4/1998 |
| EP | 1 053 945 | 11/2000 |
| JP | 55-90364 | 7/1980 |
| JP | 62-192779 | 8/1987 |
| JP | 7-299865 | 11/1995 |
| JP | 8-90740 | 4/1996 |
| JP | 9-131846 | 5/1997 |
| JP | 9-252919 | 9/1997 |
| JP | 10-34760 | 2/1998 |
| JP | 10-138377 | 5/1998 |
| JP | 10-180846 | 7/1998 |
| JP | 11-77903 | 3/1999 |
| JP | 11-151142 | 6/1999 |
| JP | 11-254631 | 9/1999 |
| JP | 2000-15767 | 1/2000 |
| JP | 2000-218746 | 8/2000 |
| WO | WO 00/71422 | 11/2000 |
| WO | WO 02/28577 A2 | 4/2002 |
| WO | WO 02/066227 A1 | 8/2002 |
| WO | WO 02/074522 A1 | 9/2002 |
| WO | WO 2004/078609 | 9/2004 |

* cited by examiner

FIG 1
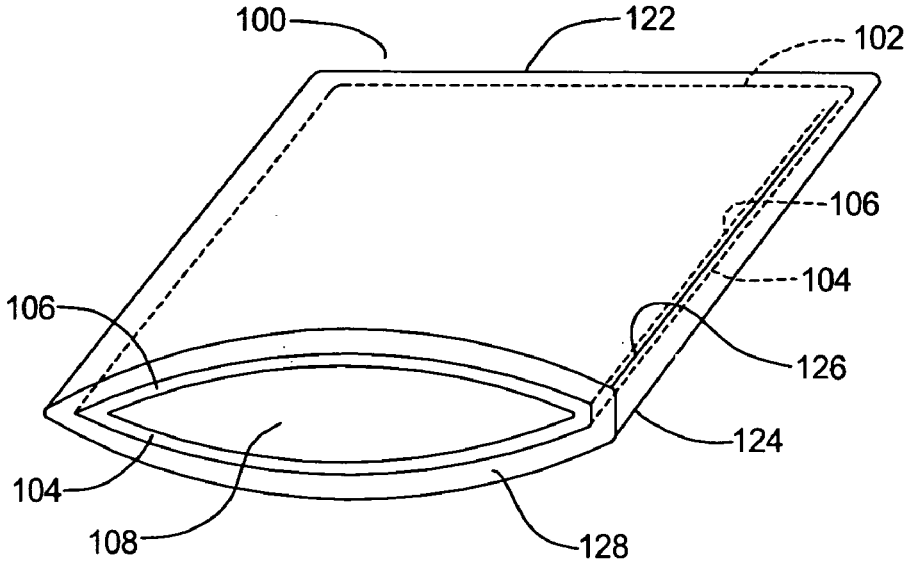
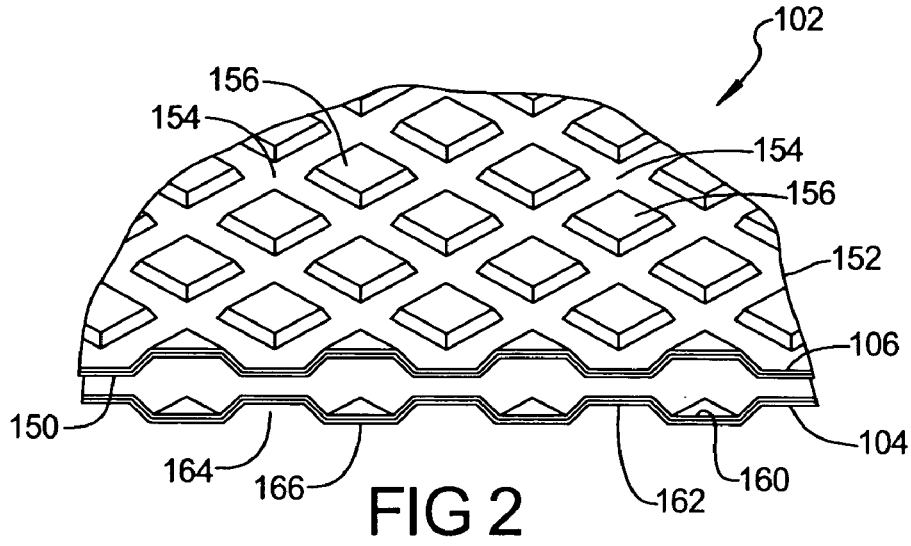
FIG 2

FIG 10A
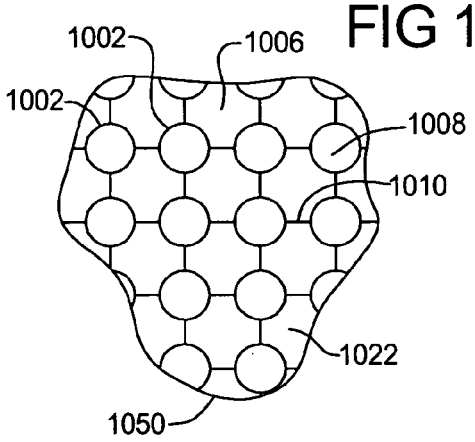
FIG 10B
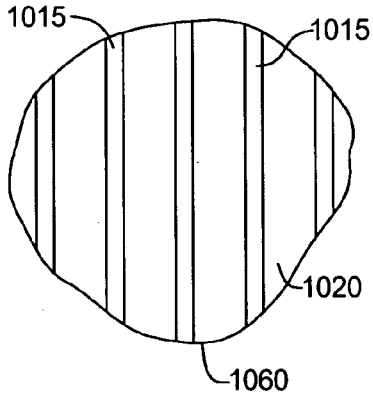
FIG 11A
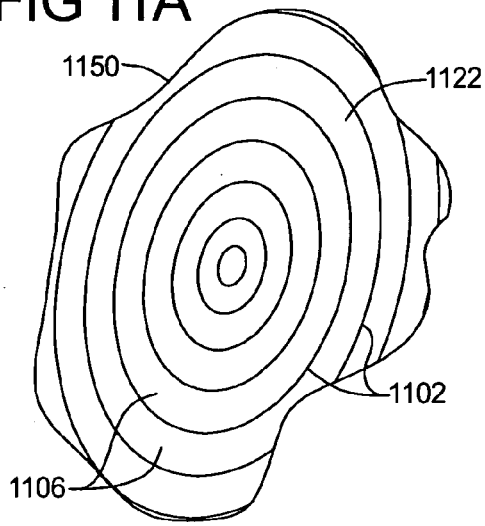
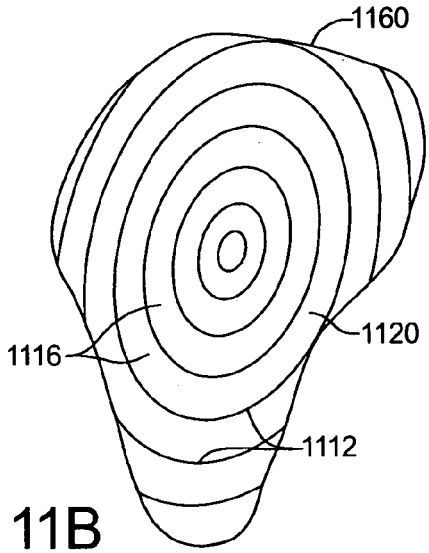
FIG 11B

FLEXIBLE COMPOSITE BAG FOR VACUUM SEALING

RELATED APPLICATION

This application claims priority to U.S. Provisional Patent Application No. 60/529,784, entitled, "Flexible Composite Bag for Vacuum Sealing" by Hongyu Wu, filed on Dec. 16, 2003, and which is hereby incorporated by reference in its entirety.

This application is related to application number 7,850, which issued as U.S. Pat. No. Re. 34,929, filed Jan. 22,1993 by inventor Hanns J. Kristen, the entire contents of which is hereby incorporated by reference as if fully set forth herein.

FIELD OF THE INVENTION

This invention relates to packaging materials for use with vacuum packaging machines.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1 is a perspective view illustrating a composite bag comprising an inner bag within the cavity of an outer bag.

FIG. 2 is an enlarged perspective view illustrating the outer surface of the panels of the inner bag.

FIG. 10 and FIG. 11 illustrate inner surfaces of panels of an inner bag.

DETAILED DESCRIPTION OF THE PREFERRED EMBODIMENT

Figure 3:
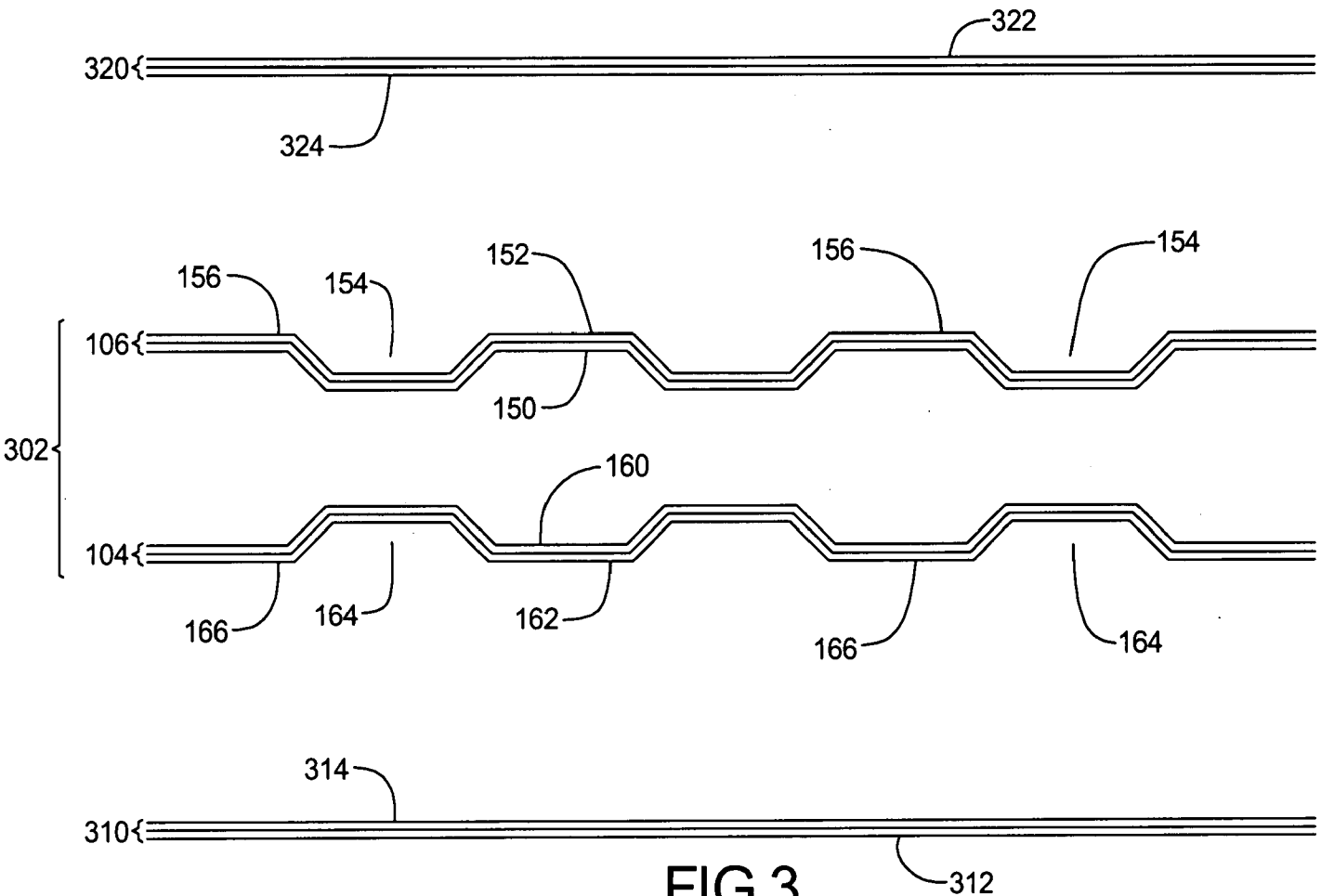
FIG. 3 is a cross-sectional view illustrating the structure of the outer bag and the inner bag according to one embodiment.

FIG. 1 shows a flexible composite bag 100 that has an outer flexible bag 122 and an inner flexible bag 102. Outer bag 122 has an open end 128. Inner bag 102 has an open end 108. When the open ends 128 and 108 are placed in an air tight vacuum channel (not shown) of a vacuum packaging machine (not shown), the air from the interior of the inner bag and from the space between the inner bag and the outer bag can be extracted by means of a vacuum pump that is operably connected to the vacuum channel. Vacuum packaging machines are well known in the art. Examples of vacuum packaging machines are FoodSaver® Appliances sold by Tilia, Inc.

Outer bag 122 has two panels, namely, a top panel 126 and a bottom panel 124. Inner bag 102 has two panels, namely, a top panel 106 and a bottom panel 104. Each panel of outer bag 122 and the inner bag 102 is made of two layers, according to certain embodiments. The two layers of a panel include an inner heat sealable layer with thermal properties, such as a thermoplastic material, and an outer gas-impermeable layer to provide a barrier against an influx of air to the interior of the bag. According to certain embodiments, the panels of the inner bag 102 and the outer bag 122 are joined together at opposite lateral sides thereof to define a chamber adapted to hold a product disposed therein.

FIG. 2 is an enlarged perspective view illustrating the outer surface of the panels of the inner bag 102, according to certain embodiments. FIG. 2 shows a crisscrossing channel design on the outer surface 152 of top panel 106. The outer surface 162 of bottom panel 104 has the same crisscrossing design but is not completely visible in FIG. 2.

For example, as shown by top panel 106, the crisscrossing channel design comprises a plurality of grooves 154 and a plurality of raised island-like protuberances 156. The plurality of grooves 154 define intercommunicating channels entirely around and between the raised island-like protuberances 156. Such a crisscrossing design is formed on both the inner surface 150 (inner layer) and outer surface 152 (outer layer) of top panel 106. The bottom panel 104 has a similar or same crisscrossing channel design that comprises a plurality of grooves 164 and a plurality of raised island-like protuberances 166. The plurality of grooves 164 define intercommunicating channels entirely around and between the raised island-like protuberances 166. Such a crisscrossing design is formed on both the inner surface 160 (inner layer) and outer surface 162 (outer layer) of bottom panel 104.

Figure 4:
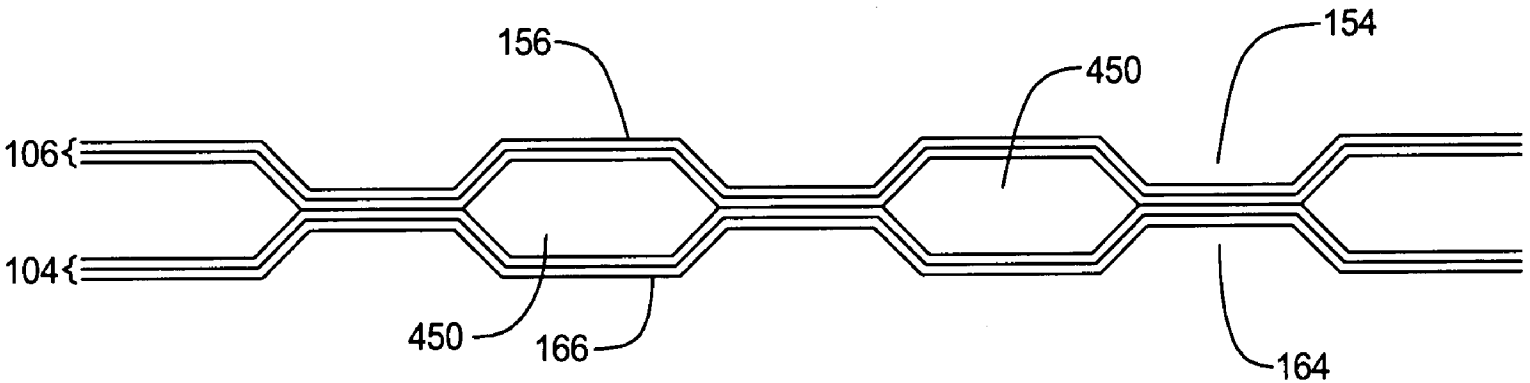
FIG. 4 is a cross-sectional view illustrating the structure of the inner bag according to one embodiment.

When the inner surface 160 of bottom panel 104 touches the inner surface 150 of top panel 106, the bottom of channels of inner surface 160 of bottom panel 104 more or less coincide with the bottom of channels of the inner surface 150 of top panel 106. The island-like-protuberances 166 of inner surface 160 of bottom panel 104 more or less forms a cup under the island-like-protuberances 156 of the inner surface 150 of top panel 106 when the inner surface 150 touch the inner surface 160. Thus, island-like-protuberances 166 of inner surface 160 and the island-like-protuberances 156 of the inner surface 150 together form pockets of spaces, shown as pockets 450 in FIG. 4. In FIG. 4, the top panel 106 of the inner bag touches the bottom panel 104 of the inner bag. For example, the bottom portion of the groove 154 touches the bottom portion of groove 164.

According to certain embodiments, when the inner bag 102 has a crisscrossing channel design as shown in FIG. 2, each panel of the outer bag 122 may be composed of flat layers of the same material as the layers of the panels of the inner bag. The outer bag is not shown in FIG. 2.

FIG. 3 is a cross-sectional view illustrating the structure of the outer bag and the inner bag according to one embodiment. FIG. 3 shows the top panel 106 and bottom panel 104 of the inner bag. FIG. 3 shows the cross-sectional views of the outer surface 152 (outer layer) and inner surface 150 (inner layer) that are both formed to make grooves 154 and the island-like-protuberances 156 of the crisscrossing channel design as previously described with reference to FIG. 2. FIG. 3 also shows the cross-sectional views of the outer surface 162 (outer layer) and inner surface 160 (inner layer) that are both formed to make grooves 164 and the island-like-protuberances 166 of the crisscrossing channel design. Each island-like protuberance and each channel is shown as being trapezoidal, when viewed in cross section. The protuberances are formed in the panel to form a plurality of raised ridges of the outer surface thereof that project outwardly therefrom to define the channels therein. In the embodiment shown of FIG. 3, the outer surface areas of the ridges are at least generally flat and co-planar relative to each other.

FIG. 3 also shows the cross-sectional view of the top panel 320 of the outer bag and the bottom panel 310 of the outer bag. Top panel 320 is composed of a flat outer surface 322 (outer layer) and a flat an inner surface 324 (inner layer). Bottom panel 310 is composed of a flat outer surface 312 (outer layer) and a flat an inner surface 314 (inner layer).

Figure 5:
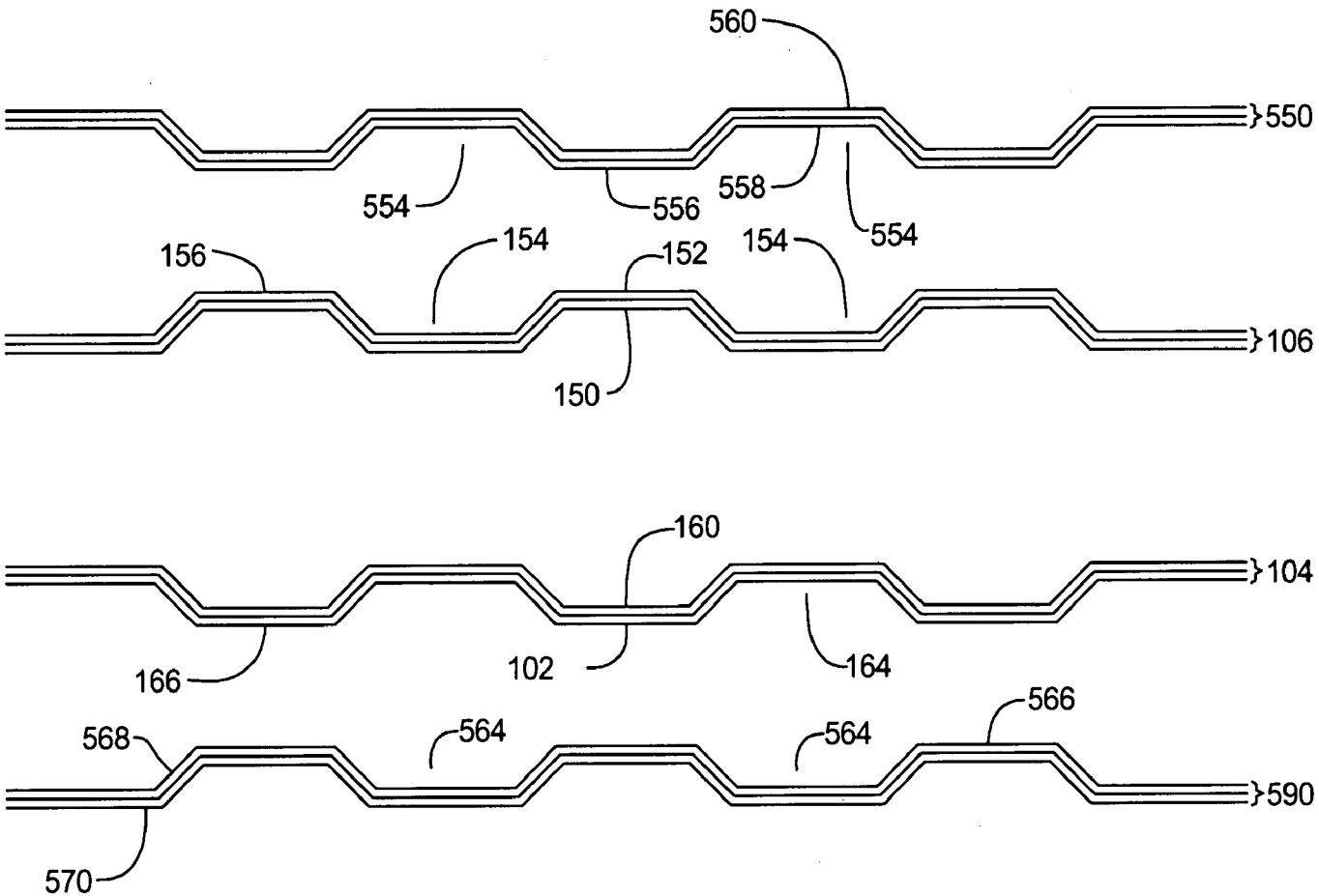
FIG. 5 is a cross-sectional view illustrating the structure of the outer bag and the inner bag according to another embodiment.

FIG. 5 is a cross-sectional view illustrating the structure of the outer bag and the inner bag according to another embodiment. FIG. 5 shows an embodiment where the top panel 106 and bottom panel 104 of the inner bag is as previously described with reference to FIG. 3. However, in FIG. 5, the top and bottom panels of the outer bag are not flat as described with reference to FIG. 3. In certain embodiments, as shown in FIG. 5, the top and bottom panels of the outer bag possess a crisscrossing channel design. However, as shown in FIG. 5, the crisscrossing channel design of the top and bottom panels of the outer bag is a mirror image of the crisscrossing channel design of the top and bottom panels of the inner bag as shown in FIG. 5.

To explain, the top panel 550 of the outer bag is composed of inner surface 558, outer surface 560, grooves 554 and island-like-protuberances 556. The bottom panel 590 of the outer bag is composed of inner surface 568, outer surface 570, grooves 564 and island-like-protuberances 566. When the inner surface 558 of top panel 550 of the outer bag touches the outer surface 152 of top panel 106 of the inner bag, the bottom of the island-like-protuberances of inner surface 558 will touch the bottom of the island-like-protuberances of outer surface 152. The groove 554 of inner surface 558 more or less forms a cup over the groove 154 of the outer surface 152 when the outer surface 152 touches the inner surface 558. Thus, grooves 554 and the grooves 154 together form pockets of spaces when the outer surface 152 touches the inner surface 558.

Similarly, when the inner surface 568 of bottom panel 590 of the outer bag touches the outer surface 162 of bottom panel 104 of the inner bag, the bottom of the island-like-protuberances of inner surface 568 will touch the bottom of the island-like-protuberances of outer surface 162. The groove 564 of inner surface 568 more or less forms a cup under the groove 164 of the outer surface 162 when the outer surface 162 touches the inner surface 568. Thus, grooves 564 and the grooves 164 together form pockets of spaces when the outer surface 162 of bottom panel 104 of the inner bag touches the inner surface 568 of bottom panel 590 of the outer bag.

Figure 6:
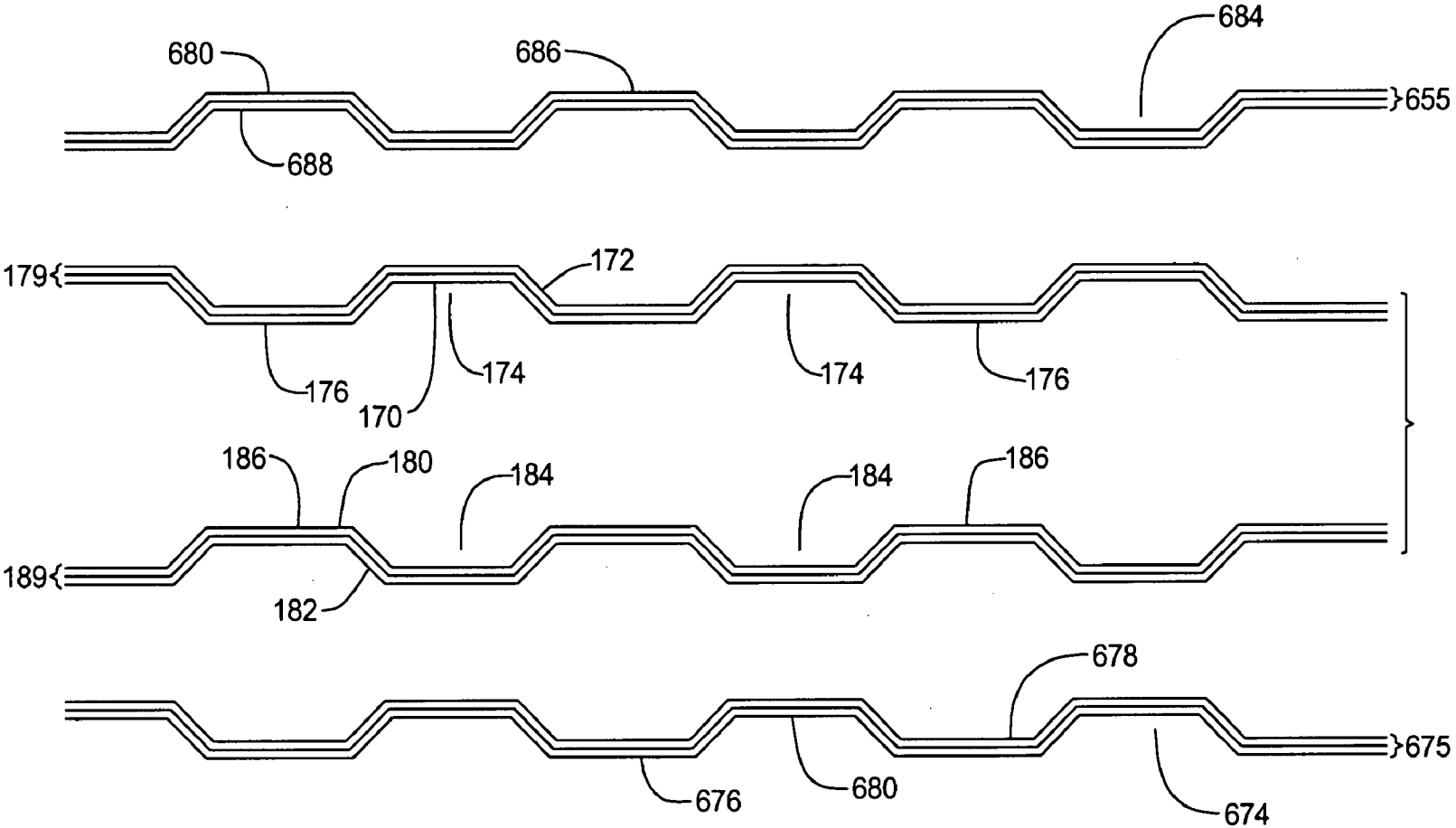
FIG. 6 is a cross-sectional view illustrating the structure of the outer bag and the inner bag according to yet another embodiment.

FIG. 6 is a cross-sectional view illustrating the structure of the outer bag and the inner bag according to yet another embodiment. In FIG. 6, the top surface areas of the island-like protuberances appear on the inner surfaces of the panels of the inner bag. Similarly, the channels also appear on the inner surfaces of the panels of the inner bag.

For example, when the inner surface 170 of top panel 179 of the inner bag touches the inner surface 180 of bottom panel 189 of the inner bag, the surface area of the island-like-protuberances 176 of inner surface 170 will touch the surface area of the island-like-protuberances of outer surface 186 of inner surface 180. The groove 174 of inner surface 170 more or less forms a cup over the groove 184 of the inner surface 180 when the inner surface 170 of top panel 179 touches the inner surface 180 of bottom panel 189. Thus, grooves 174 and the grooves 184 together form pockets of spaces when the inner surface 170 of top panel 179 touches the inner surface 180 of bottom panel 189 of the inner bag.

When the inner surface 688 of top panel 655 of the outer bag touches the outer surface 172 of top panel 179 of the inner bag, the bottom of channels of inner surface 688 of top panel 655 more or less coincide with the bottom of channels of the outer surface 172 of top panel 179. Top panel 655 of the outer bag also has an outer surface 680. The island-like-protuberances 686 of inner surface 688 of top panel 655 more or less forms a cup over the island-like-protuberances 176 of the outer surface 172 of top panel 179 when the inner surface 688 touches the outer surface 172. Thus, island-like-protuberances 686 and the island-like-protuberances 176 together form pockets of spaces when the inner surface 688 touches the outer surface 172. Similarly, the island-like-protuberances 676 of inner surface 678 of bottom panel 675 of the outer bag more or less forms a cup under the island-like-protuberances 186 of the outer surface 182 of bottom panel 189 of the inner bag when the inner surface 678 touches the outer surface 182. Bottom panel 675 of the outer bag also has an outer surface 680. Also the bottom of groove 184 touches the bottom of groove 674 when the inner surface 678 touches the outer surface 182.

Figure 7:
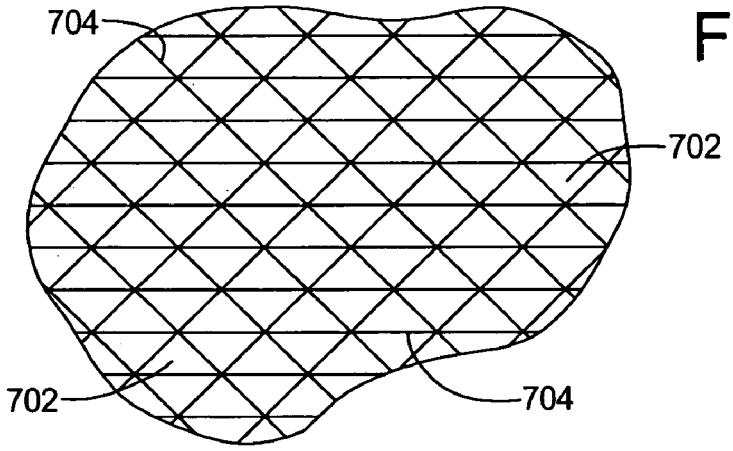
FIG. 7, FIG. 8 and FIG. 9 illustrate various patterns according to certain embodiments.
Figure 8:
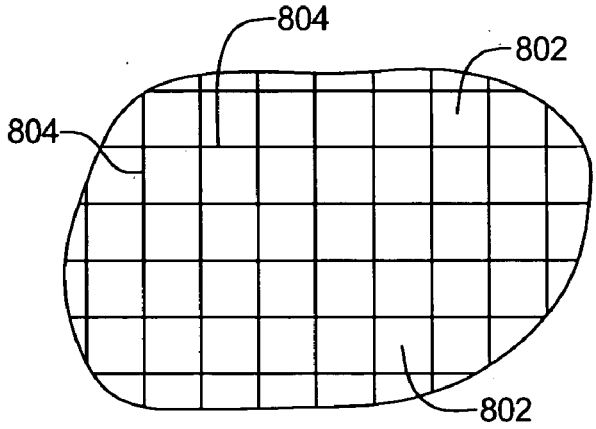
Figure 9:
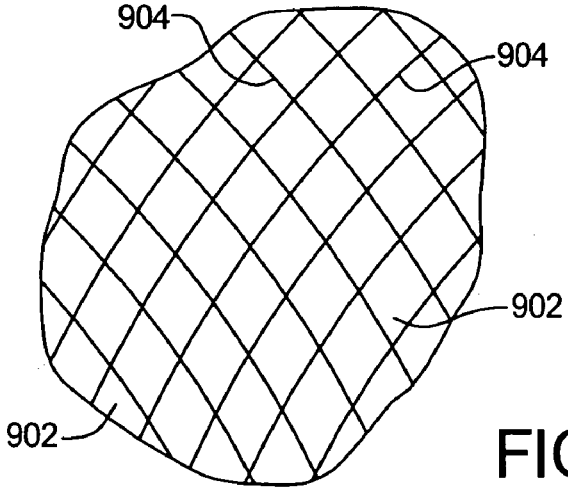

FIG. 7, FIG. 8 and FIG. 9 illustrate various patterns according to certain embodiments. In FIG. 7 groves 704 are represented by the thick lines. The island like-protuberances 702 are represented by the white spaces. In FIG. 8 groves 804 are represented by the thick lines. The island like-protuberances 802 are represented by the white spaces. In FIG. 9 groves 904 are represented by the thick lines. The island like-protuberances 902 are represented by the white spaces. The patterns as shown in FIG. 7, FIG. 8 and FIG. 9 can be used for either the inner bag and/or the outer bag. The patterns that are used for the inner bag and the outer bag will vary from implementation to implementation . The embodiments are not restricted to any particular pattern. Any arbitrary pattern can be used as long as there are raised portions interspersed among channels on at least one surface of the of the panel. The raised portion and channels can be of arbitrary shape. The flip surface of the panel can be a mirror image of the other surface of the panel. For example, there are raised ridges on the flip surface corresponding to the channels of the other surface and there are wells on the flip surface corresponding to the raised portions of the other surface.

FIG. 10 and FIG. 11 illustrate inner surfaces of panels of an inner bag. FIG. 10 shows inner surface 1022 of panel 1050. Inner surface 1022 includes raised rings 1002, raised ridges 1010, wells 1006 and wells 1008. Panel 1060 has an inner surface 1020. There are straw-like channels on inner surface 1020. The inner surface 1020 will overlie inner surface 1022 to form an inner bag.

According to certain embodiments, panel 1002 can be the inner surface of an outer bag that overlies outer surface of an inner bag where such an outer surface looks like the inner surface of panel 1060. According to certain other embodiments, panel 1060 can be the inner surface of an outer bag that overlies outer surface of an inner bag where such an outer surface looks like the inner surface of panel 1002.

FIG. 11 shows inner surface 1122 of panel 1150. Inner surface 1122 is composed of raised rings 1102 with ring-like wells 1106 formed between the raised rings. Panel 1160 has similar raised rings 1112 with ring-like wells 1116 formed between the raised rings 1112. The inner surface 1160 will overlie inner surface 1150 to form an inner bag.

According to certain embodiments, panel 1150 can be the inner surface of an outer bag that overlies outer surface of an inner bag where such an outer surface looks like the inner surface of panel 1160.

The embodiments are not restricted to any one method of manufacturing the patterned composite flexible bags. One example of manufacturing flexible bags is described in application Ser. No. 10/169,485, entitled, "Method for Preparing Air Channel-Equipped Film For Use In Vacuum Package, by Kyul-Joo Lee, filed on Jun. 6, 2002, and which is hereby incorporated by reference in its entirety.

In the foregoing specification, embodiments of the invention have been described with reference to numerous specific details that may vary from implementation to implementation. The specification and drawings are, accordingly, to be regarded in an illustrative rather than a restrictive sense.

What is claimed is:

1. A flexible composite bag for vacuum packaging, said bag comprising:

a first and second flexible panels, joined together at opposite lateral sides thereof to define a chamber adapted to have a product disposed therein; and each of said first and second panels having a pattern such that interconnecting channels are formed between said first panel and a third panel and between said second panel and a fourth panel wherein said third and fourth panels form an outer bag enclosing said first and second flexible panels;

wherein an outer surface of said first panel has a corresponding pattern that includes a plurality of columns of raised rings and wherein an inner surface of said third panel has a corresponding pattern that includes a plurality of straw-like channels that are adapted to overlie said raised rings for allowing intercommunication between said raised rings when said third panel is superimposed over said first panel.

2. The bag of claim 1, wherein said third and fourth flexible panels each has substantially smooth inner surfaces that come in contact with said corresponding first and second panels.

3. The bag of claim 1, wherein said third and fourth flexible panels each has patterned surfaces that come in contact with said corresponding first and second panels.

4. The bag of claim 1, wherein said first and second panels each comprise multilayers.

5. The bag of claim 4, wherein one of said multilayers includes a heat sealable layer.

6. The bag of claim 1, wherein said pattern includes a plurality of protuberances formed in a generally regular and waffle-like pattern and said plurality of protuberances define a plurality of interconnecting channels around and between said protuberances.

7. The bag of claim 6, wherein a top surface area of each of said protuberances is substantially rectangular in shape.

8. The bag of claim 6, wherein a top surface area of each of said protuberances is substantially triangular in shape.

9. A flexible composite bag for vacuum packaging, said bag comprising;

a first and second flexible panels, joined together at opposite lateral sides thereof to define a chamber adapted to have a product disposed therein; and each of said first and second panels having a pattern such that interconnecting channels are formed between said first panel and a third panel and between said second panel and a fourth panel wherein said third and fourth panels form an outer bag enclosing said first and second flexible panels;

wherein an outer surface of said second panel has a corresponding pattern that includes a plurality of columns of raised rings and wherein an inner surface of said fourth panel has a corresponding pattern that includes a plurality of straw-like channels that are adapted to overlie said raised rings for allowing intercommunication between said raised rings when said fourth panel is superimposed over said second panel.

10. A flexible composite bag for vacuum packaging, said bag comprising:

a first and second flexible panels, joined together at opposite lateral sides thereof to define a chamber adapted to have a product disposed therein; and each of said first and second panels having a pattern such that interconnecting channels are formed between said first panel and a third panel and between said second panel and a fourth panel wherein said third and fourth panels form an outer bag enclosing said first and second flexible panels;

wherein an outer surface of said first panel has a corresponding pattern that includes a plurality of concentric raised rings and wherein an inner surface of said third panel has a corresponding pattern that includes a plurality of straw-like channels that are adapted to overlie said concentric raised rings for allowing intercommunication between said concentric raised rings when said third panel is superimposed over said first panel.

11. A flexible composite bag for vacuum packaging, said bag comprising:

a first and second flexible panels, joined together at opposite lateral sides thereof to define a chamber adapted to have a product disposed therein; and each of said first and second panels having a pattern such that interconnecting channels are formed between said first panel and a third panel and between said second panel and a fourth panel wherein said third and fourth panels form an outer bag enclosing said first and second flexible panels;

wherein an outer surface of said second panel has a corresponding pattern that includes a plurality of concentric raised rings and wherein an inner surface of said fourth panel has a corresponding pattern that includes a plurality of straw-like channels that are adapted to overlie said concentric raised rings for allowing intercommunication between said concentric raised rings when said fourth panel is superimposed over said second panel.

12. A flexible composite bag for vacuum packaging, said bag comprising:

a first and second flexible panels, joined together at opposite lateral sides thereof to define a chamber adapted to have a product disposed therein; and each of said first and second panels having a pattern such that interconnecting channels are formed between said first and second panels when said first and second panels are superimposed on each other;

wherein said inner surface of said first panel has a corresponding pattern that includes a plurality of columns of raised rings and wherein an inner surface of said second panel has a corresponding pattern that includes a plurality of straw-like channels that are adapted to overlie said raised rings for allowing intercommunication between said raised rings when said first panel is superimposed over said second panel.

13. The bag of claim 12, further comprising:

a third and fourth flexible panels forming an outer bag that encloses said first and second panels.

14. The bag of claim 13, wherein said third and fourth flexible panels each has substantially smooth inner surfaces that come in contact with said corresponding first and second panels.

15. The bag of claim 13, wherein said third and fourth flexible panels each has patterned surfaces that come in contact with said corresponding first and second panels.

16. The bag of claim 12 wherein said first and second panel each comprise multilayer.

17. The bag of claim 16, wherein one of said multilayers includes a heat sealable layer.

18. The bag of claim 12, wherein said pattern includes a plurality of protuberances formed in a generally regular and waffle-like pattern and said protuberances define a plurality of interconnecting channels around and between said protuberances.

19. The bag of claim 18, wherein a top surface area of each of said protuberances is substantially rectangular in shape.

20. The bag of claim 18, wherein a top surface area of each of said protuberances is substantially triangular in shape.

21. A flexible composite bag for vacuum packaging, said bag comprising:

a first and second flexible panels, joined together at opposite lateral sides thereof to define a chamber adapted to have a product disposed therein; and each of said first and second panels having a patter such that interconnecting channels are formed between said first and second panels when said first and second panels are superimposed on each other;

wherein said inner surface of said first panel has a corresponding pattern that includes a plurality of concentric raised rings and wherein an inner surface of said second panel has a corresponding pattern that includes a plurality of straw-like channels that are adapted to overlie said concentric raised rings for allowing intercommunication between said concentric raised rings when said first panel is superimposed over said second panel.

22. A method for making a flexible composite bag for vacuum packaging, wherein forming a pattern further comprises forming on an outer surface of said second panel a corresponding pattern that includes a plurality of columns of raised rings and further forming on an inner surface of said fourth panel a corresponding pattern that includes a plurality of straw-like channels that are adapted to overlie said raised rings for allowing intercommunication between said raised rings when said fourth panel is superimposed over said second panel, said bag comprising:

using a first and second flexible panels, joined together at opposite lateral sides thereof to define a chamber adapted to have a product disposed therein; and forming a pattern on said first and second panels such that interconnecting channels are formed between said first panel and a third panel and between said second panel and a fourth panel wherein said third and fourth panels form an outer bag enclosing said first and second flexible panels;

wherein forming a pattern further comprises forming on an outer surface of said second panel a corresponding pattern that includes a plurality of columns of raised rings and further forming on an inner surface of said fourth panel a corresponding pattern that includes a plurality of straw-like channels that are adapted to overlie said raised rings for allowing intercommunication between said raised rings when said fourth panel is superimposed over said second panel.

23. The method of claim 22, further comprising forming substantially smooth inner surfaces for said third and fourth flexible panels that come in contact with said corresponding first and second panels.

24. The method of claim 22, further comprising forming patterned inner surfaces for said third and fourth flexible panels that come in contact with said corresponding first and second panels.

25. The method of claim 22, wherein said pattern includes a plurality of protuberances formed in a generally regular and waffle-like pattern and said plurality of protuberances define a plurality of interconnecting channels around and between said protuberances.

26. The method of claim 25, wherein a top surface area of each of said protuberances is substantially rectangular in shape.

27. The method of claim 25, wherein a top surface area of each of said protuberances is substantially triangular in shape.

28. The method of claim 22, wherein forming a pattern includes forming a plurality of columns of raised rings on an outer surface of said first panel and further forming on an inner surface of said third panel a corresponding pattern that includes a plurality of straw-like channels that are adapted to overlie said raised rings for allowing intercommunication between said raised rings when said third panel is superimposed over said first panel.

29. The method of claim 22, A method for making a flexible composite bag for vacuum packaging, wherein forming a pattern further comprises forming on an outer surface of said second panel a corresponding pattern that includes a plurality of columns of raised rings and further forming on an inner surface of said fourth panel a corresponding pattern that includes a plurality of straw-like channels that are adapted to overlie said raised rings for allowing intercommunication between said raised rings when said fourth panel is superimposed over said second panel, said bag comprising:

using a first and second flexible panels, joined together at opposite lateral sides thereof to define a chamber adapted to have a product disposed therein; and forming a pattern on said first and second panels such that interconnecting channels are formed between said first panel and a third panel and between said second panel and a fourth panel wherein said third and fourth panels form an outer bag enclosing said first and second flexible panels;

wherein forming a pattern further comprises forming on an outer surface of said second panel a corresponding pattern that includes a plurality of concentric raised rings and further forming on an inner surface of said fourth panel a corresponding pattern that includes a plurality of straw-like channels that are adapted to overlie said concentric raised rings for allowing intercommunication between said concentric raised rings when said fourth panel is superimposed over said second panel.

30. A method for making a flexible composite bag for vacuum packaging, wherein forming a pattern further comprises forming on an outer surface of said second panel a corresponding pattern that includes a plurality of columns of raised rings and further forming on an inner surface of said fourth panel a corresponding pattern that includes a plurality of straw-like channels that are adapted to overlie said raised rings for allowing intercommunication between said raised rings when said fourth panel is superimposed over said second panel, said bag comprising:

using a first and second flexible panels, joined together at opposite lateral sides thereof to define a chamber adapted to have a product disposed therein; and forming a pattern on said first and second panels such that interconnecting channels are formed between said first panel and a third panel and between said second panel and a fourth panel wherein said third and fourth panels form an outer bag enclosing said first and second flexible panels;

wherein forming a pattern further includes forming on an outer surface of said first panel a corresponding pattern that includes a plurality of concentric raised rings and further forming on an inner surface of said third panel a corresponding pattern that includes a plurality of straw-like channels that are adapted to overlie said concentric raised rings for allowing intercommunication between said concentric raised rings when said third panel is superimposed over said first panel.

* * * * *